US007738823B2

(12) United States Patent
Umezawa et al.

(10) Patent No.: US 7,738,823 B2
(45) Date of Patent: Jun. 15, 2010

(54) IMAGE FORMING APPARATUS FOR REALIZING DOWNSIZING OF A MAIN BODY OF THE APPARATUS

(75) Inventors: Masao Umezawa, Mishima (JP); Eiichiro Kimizuka, Mishima (JP); Ichiro Yasumaru, Mishima (JP); Masao Amano, Susono (JP); Junichi Ochi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/109,237

(22) Filed: Apr. 24, 2008

(65) Prior Publication Data

US 2008/0317520 A1 Dec. 25, 2008

(30) Foreign Application Priority Data

May 9, 2007 (JP) ..... 2007-124691
May 9, 2007 (JP) ..... 2007-124692

(51) Int. Cl.
*G03G 15/01* (2006.01)

(52) U.S. Cl. ..... 399/302; 399/82

(58) Field of Classification Search ..... 399/302
See application file for complete search history.

(56) References Cited

U.S. PATENT DOCUMENTS

| | | | | |
|---|---|---|---|---|
| 6,490,422 | B2 | 12/2002 | Marumoto | |
| 6,775,494 | B2 | 8/2004 | Kusaba | |
| 2004/0126128 | A1* | 7/2004 | Shibata | 399/82 |

FOREIGN PATENT DOCUMENTS

| | | | |
|---|---|---|---|
| JP | 6-138742 | A | 5/1994 |
| JP | 6-138744 | A | 5/1994 |
| JP | 6-161168 | A | 6/1994 |
| JP | 11-153914 | A | 6/1999 |
| JP | 11-223970 | A | 8/1999 |
| JP | 11-224036 | A | 8/1999 |
| JP | 2002-062784 | A | 2/2002 |
| JP | 2002-082513 | A | 3/2002 |
| JP | 2002-251081 | A | 9/2002 |
| JP | 2002-328543 | A | 11/2002 |
| JP | 2004-046197 | A | 2/2004 |
| JP | 2004-279919 | A | 10/2004 |
| JP | 2005-070206 | A | 3/2005 |
| JP | 2005-070207 | A | 3/2005 |
| JP | 2006-163155 | A | 6/2006 |
| WO | 2006/062026 | A1 | 6/2006 |

* cited by examiner

*Primary Examiner*—David M Gray
*Assistant Examiner*—Roy Yi
(74) *Attorney, Agent, or Firm*—Canon U.S.A., Inc. I.P. Division

(57) ABSTRACT

An image forming apparatus includes a substantially horizontally arranged image bearing member; a developing unit, including a plurality of developing devices and supporting the developing devices rotatably relative to the image bearing member; a movable intermediate transfer belt supported by first and second rotation members and facing the developing unit; a primary transfer member forming, together with the image bearing member, a primary transfer portion located near the first rotation member in a moving direction of the intermediate transfer belt, through the intermediate transfer belt; and a secondary transfer member forming, together with the second rotation member, a secondary transfer portion through the intermediate transfer belt. A toner image formed on the image bearing member by the developing unit is transferred on the intermediate transfer belt at the primary transfer portion, and is transferred on a recording material at the secondary transfer portion.

14 Claims, 8 Drawing Sheets

IMAGE FORMING APPARATUS FOR REALIZING DOWNSIZING OF A MAIN BODY OF THE APPARATUS

BACKGROUND OF THE INVENTION

1. Field of the Invention

The present invention relates to image forming apparatuses such as copiers and printers, and more particularly to an image forming apparatus having an intermediate transfer belt.

2. Description of the Related Art

There are various kinds of image forming apparatuses which employ an image forming process of electrophotographic type or electrostatic recording type. Such various kinds of image forming apparatuses have therein photosensitive drums as image bearing members which are widely used in printers and copiers. Process units, such as a charging unit, an exposure unit, a developing unit, a transfer unit, and a cleaning unit are provided in the vicinity of such a photosensitive drum. Also, a recording material conveying unit, a fixing unit, and the like, are provided in the apparatus.

As shown in FIG. 8, there is an example image forming apparatus, in which, when a toner image on an image bearing member 300 is to be transferred on a recording material, an intermediate transfer belt 301 bears a toner image transferred from an image bearing member (which is a device to allow the belt 301 to bear the toner image).

In many cases, the length of the intermediate transfer belt cannot be a certain length or smaller due to the condition of the maximum size of a recording material to be output from an image forming apparatus. If a main body of the apparatus is to be decreased in size, the length of the intermediate transfer belt may affect the overall dimensions of the main body.

In the above apparatus, the intermediate transfer belt is obliquely arranged, a photosensitive member is arranged slightly above the center of the intermediate transfer belt, and a developing unit is arranged above the photosensitive member.

With this configuration, it is difficult to decrease the size of the main body.

Moreover, as shown in FIG. 8, if a waste-toner container 302 is provided only at an upper portion of a primary-transfer nip portion, for example, when a user opens a front cover to replace a developing device, light may enter, and a photosensitive drum may be exposed to the light, thereby generating a defective image.

Accordingly it would be advantageous to provide an image forming apparatus that overcomes the aforementioned disadvantages described above.

SUMMARY OF THE INVENTION

The present invention provides an image forming apparatus including a developing unit configured to support a plurality of developing devices rotatably relative to an image bearing member, and an intermediate transfer belt, and being capable of decreasing the size of a main body of the apparatus.

The present invention provides an image forming apparatus including an image bearing member; a developing unit including a plurality of developing devices, and being configured to support the developing devices rotatably relative to the image bearing member; a movable intermediate transfer belt supported by first and second rotation members; a primary transfer member, the primary transfer member and the image bearing member being configured to form a primary transfer portion with the intermediate transfer belt being interposed therebetween; and a secondary transfer member, the secondary transfer member and the second rotation member being configured to form a secondary transfer portion with the intermediate transfer belt being interposed therebetween. A toner image which is formed on the image bearing member by the developing unit is transferred on the intermediate transfer belt at the primary transfer portion, the toner image on the intermediate transfer belt is conveyed to the first rotation member and then to the secondary transfer portion, and the toner image is transferred on a recording material. The intermediate transfer belt is arranged substantially horizontally, the primary transfer portion being located on a side of the first rotation member with respect to a center portion between the first rotation member and the second rotation member in a moving direction of the intermediate transfer belt, and the developing unit faces the intermediate transfer belt.

Further features and aspects of the present invention will become apparent from the following description of exemplary embodiments with reference to the attached drawings.

DESCRIPTION OF THE EMBODIMENTS

Various embodiments, features and aspects of the present invention are now herein described below with reference to the attached drawings.

First Exemplary Embodiment

First, the overall configuration of an example color image forming apparatus according to an embodiment of the invention is described.

Figure 1:
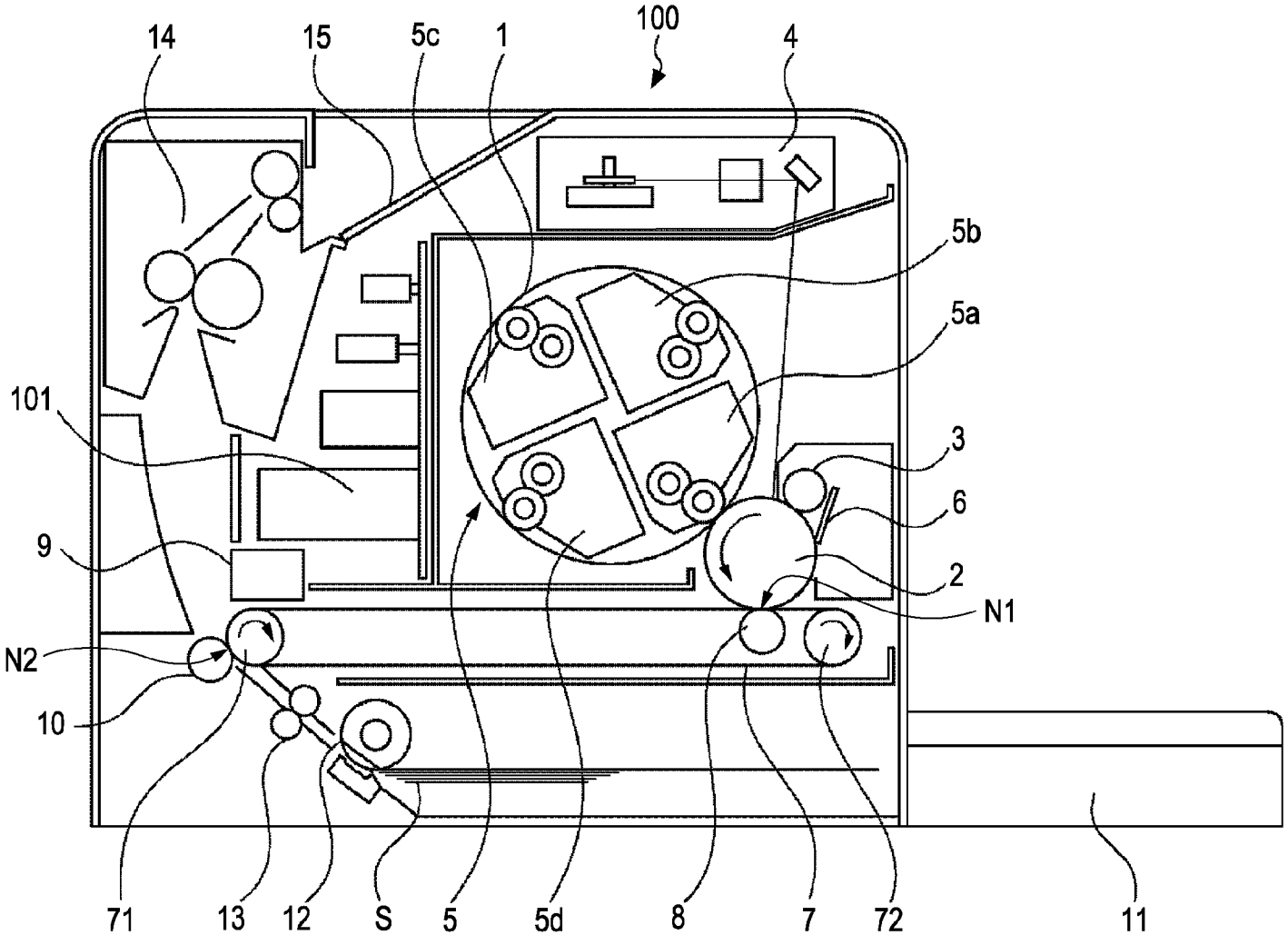
FIG. 1 is an illustration showing an example image forming apparatus according to a first exemplary embodiment of the present invention.

The image forming apparatus according to the embodiment of the invention is a four-full-color laser beam printer. FIG. 1 is a cross section showing the overall configuration.

As shown in FIG. 1, a main body 100 of an image forming apparatus includes a photosensitive drum 2 as an image bearing member. A charging unit, an exposure unit, a developing unit, a transfer unit, a removing unit, and the like, are provided in the vicinity of the photosensitive drum 2. A charging roller (charging unit) 3 uniformly charges the photosensitive drum 2 with electricity. An exposure device (exposure unit) 4 irradiates the photosensitive drum 2 to a laser beam, and forms a latent image. A developing unit 5 includes a plurality of developing devices (developing cartridges) 5*a* to 5*d*. The developing devices 5*a* to 5*d* develop the latent image formed on the photosensitive drum 2, using toners of colors (magenta, cyan, yellow, black) of the developing devices 5*a* to 5*d*, into a toner image. The transfer unit includes an intermediate transfer belt 7, a primary transfer roller (primary transfer member) 8, and the like, and transfers the toner image on the photosensitive drum 2 on the intermediate transfer belt 7. A drum cleaning unit (removing unit) 6 removes a toner remaining on the photosensitive drum 2.

Next, an example operation is described. The photosensitive drum 2 is rotated in a direction indicated by an arrow in FIG. 1 (counterclockwise) in synchronization with rotation of the intermediate transfer belt 7. The charging roller 3 uniformly charges the surface of the photosensitive drum 2 with electricity, and the exposure device 4 exposes a yellow image to light. Accordingly, a yellow electrostatic latent image is formed on the photosensitive drum 2.

At the same time with the formation of the electrostatic latent image, a rotary member 1 serving as a rotary developing device changer is driven to position the developing device 5*a* for yellow at a developing position. A voltage having the same polarity and substantially the same electric potential as that of the charged polarity of the photosensitive drum 2 is applied to a developing roller to allow a yellow toner to adhere on the electrostatic latent image on the photosensitive drum 2. Since the yellow toner thus adheres on the electrostatic latent image, the image is developed.

Then, a voltage having the reversed polarity, which is opposite to the polarity of the toner, is applied to the primary transfer roller (primary transfer member) 8. The primary transfer roller 8 is arranged inside the intermediate transfer belt 7. The primary transfer roller 8 and the photosensitive drum 2 form a primary-transfer nip portion N1 with the intermediate transfer belt 7 being interposed therebetween. Accordingly, the yellow toner image on the photosensitive drum 2 is primarily transferred on the intermediate transfer belt 7.

After the yellow toner image is primarily transferred as described above, the developing devices 5*b* to 5*d* for colors of magenta, cyan, and black are sequentially rotated by the driving of the rotary member 1, and are sequentially positioned at the developing position facing the photosensitive drum 2. In a manner similar to the color of yellow, the colors of magenta, cyan, and black are sequentially processed, to form electrostatic latent images, develop the images, and primarily transfer the images. Accordingly, four-color toner images are superposed on the intermediate transfer belt 7.

The developing unit 5 includes the plurality of developing devices 5*a* to 5*d*, and supports the developing devices 5*a* to 5*d* rotatably relative to the photosensitive drum 2. The developing unit 5 also includes the rotary member 1 that is rotatable while housing the developing devices 5*a* to 5*d*.

While the toner images on the intermediate transfer belt 7 are circulating, a secondary transfer roller (secondary transfer member) 10 is not in contact with the intermediate transfer belt 7. Also, a belt cleaning unit 9 is not in contact with the intermediate transfer belt 7.

A sheet feeding cassette 11 is provided at a lower portion of the apparatus, and stacks and houses sheets (recording materials) S therein. A sheet feeding roller 12 separates a single sheet S from the sheet feeding cassette 11 and feeds the sheet S to a registration roller pair 13. The registration roller pair 13 conveys the sheet S to a portion between the intermediate transfer belt 7 and the secondary transfer roller 10. At this time, the secondary transfer roller 10 is pressed to the intermediate transfer belt 7 (the state in FIG. 1). That is, the secondary transfer roller 10 and a second rotation member (described later) form a secondary-transfer nip portion N2 with the intermediate transfer belt 7 being interposed therebetween. The sheet feeding roller 12 and the registration roller pair 13 serve as a feeding unit to feed a sheet S to the secondary-transfer nip portion N2.

The voltage having the reversed polarity, which is opposite to the polarity of the toner, is applied to the secondary transfer roller 10. Accordingly, the above-mentioned four-color toner images superposed on the intermediate transfer belt 7 are secondarily transferred on the surface of a sheet S collectively.

The sheet S having the transferred toner images is conveyed to a fixing device (fixing unit) 14. The fixing device 14 heats and presses the sheet S, and thus, the toner images are fixed to the sheet S. Accordingly, a fixed image is formed on the sheet S. The sheet S is output from the fixing device 14 to a sheet output portion defined at an upper cover 15 located outside the apparatus.

The intermediate transfer belt 7 is driven and supported by a driving roller (second rotation member) 71 and a support roller (first rotation member) 72. As shown in FIG. 1, the intermediate transfer belt 7 is arranged substantially horizontally in the main body 100. That is, the intermediate transfer belt 7 is a movable belt supported by the driving roller 71 and the support roller 71 (first and second rotation members). The toner images formed on the photosensitive drum 2 by the developing unit 5 are transferred on the intermediate transfer belt 7 at the primary-transfer nip portion N1, the toner images on the intermediate transfer belt 7 are conveyed to the support roller 72 and then to the secondary-transfer nip portion N2, and are transferred on the sheet S.

The primary-transfer nip portion N1 is located on a side of the support roller 72 with respect to a center portion between the support roller 72 and the driving roller 71 in a moving direction of the intermediate transfer belt 7. That is, the primary-transfer nip portion N1 is located near the support roller 72.

The length of the intermediate transfer belt 7 is restricted by the length of the maximum size sheet that the main body 100 can perform conveyance and image formation according to the specifications thereof. When the main body 100 is to be decreased in size, the length of the intermediate transfer belt 7 has a large influence on the overall dimension of the main body 100 in the lateral direction in FIG. 1. Thus, in this embodiment, the exposure device 4, the rotary member 1 including the developing devices 5*a* to 5*d* for the colors, the photosensitive drum 2, and a power board 101 are arranged so as to be within an upper projection plane of the intermediate transfer belt 7, for the length of the intermediate transfer belt 7 in the lateral direction in FIG. 1. With this arrangement, the overall dimension of the main body 100 in the lateral direction can be decreased. The power board 101 is a power unit to supply power to components of the main body 100.

Also, the intermediate transfer belt 7 is arranged substantially horizontally. Accordingly, the height of the main body 100 can be decreased. Further, the photosensitive drum 2 is arranged near the support roller 72 located downstream of the intermediate transfer belt 7 in the moving direction, the rotary member 1 is arranged upstream of the photosensitive drum 2, and a lowermost portion of the rotary member 1 is arranged at a position lower than the center of the photosensitive drum 2. Accordingly, the height of the main body 100 can be decreased.

The photosensitive drum 2 is arranged above the intermediate transfer belt 7 supported by the driving roller 71 and the support roller 72. The position of the photosensitive drum 2 is located on a side of the support roller 72 with respect to the center portion between the rollers, that is, it is located near the support roller 72 located on the downstream side in the belt conveying direction. Accordingly, the main body 100 can be decreased in size. Also, the distance from the primary-transfer nip portion N1 where the photosensitive drum 2 transfers a toner image on the intermediate transfer belt 7, to the secondary-transfer nip portion N2 where the intermediate transfer belt 7 transfers the toner image on a sheet S, can be decreased. As a result, the first print time from reception of a print signal by the main body 100 until printing and output can be decreased. That is, the distance from the primary-transfer nip portion N1 to the secondary-transfer nip portion N2 along the intermediate transfer belt 7 can be decreased, thereby accelerating the transfer timing on the sheet S.

Further, in this embodiment, the power board 101 is arranged upstream of the rotary member 1 in the belt conveying direction, the rotary member 1 being arranged above the intermediate transfer belt 7. Also, the rotating direction of the rotary member 1 is from the lower side to the upper side (clockwise in FIG. 1) at a surface of the power board 101 near the rotary member 1. With this arrangement, an air flow generated by the rotation of the rotary member 1 flows from the lower side to the upper side of the power board 101 whose temperature is elevated because of power distribution. Hence, elements on the power board 101 at the elevated temperature can be cooled, and the heat can be exhausted to an upper portion of the main body 100.

The fixing device 14 is arranged at the upper portion of the main body 100, near the power board 101. Accordingly, similarly to the power board 101, hear caused by the fixing device 14 whose temperature is elevated because of power distribution, and staying around the fixing device 14, can be exhausted to the upper portion of the main body 100 by the air flow generated by the rotation of the rotary member 1. That is, a sheet S is conveyed from the sheet feeding cassette 11 and then the sheet feeding roller 12 to the fixing device 14, or from the lower side to the upper side, and the rotary member 1 of the developing unit 5 is rotated from the lower side to the upper side in an area near the recording material conveying path. Accordingly, the heat can be efficiently exhausted.

Second Exemplary Embodiment

Figure 2:
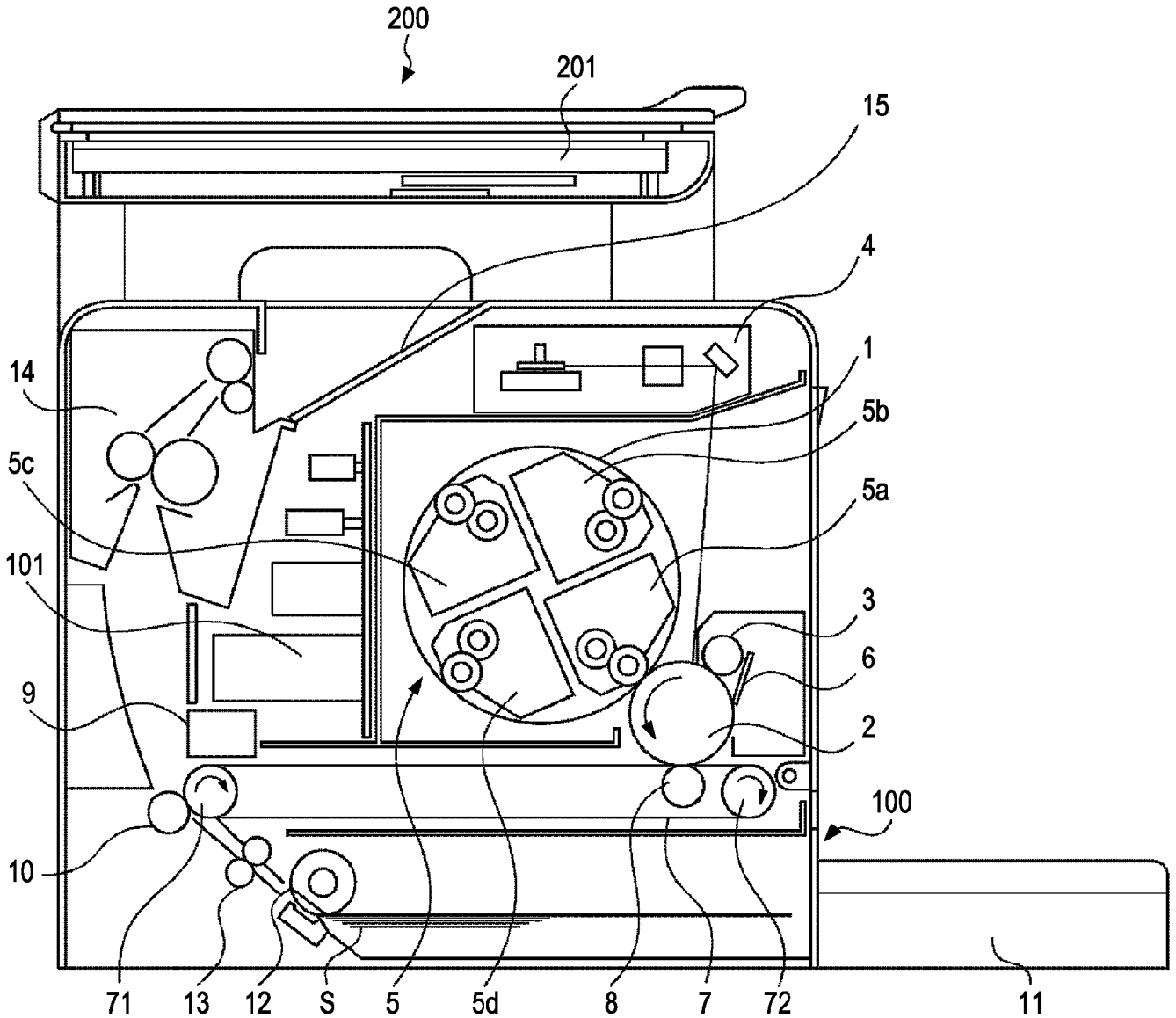
FIG. 2 is an illustration showing an example image forming apparatus according to a second exemplary embodiment of the present invention.

Next, another embodiment of the invention is described below. An image forming apparatus according to this embodiment is a four-full-color laser beam printer in which a scanning device (scanning unit) is installed to a main body of the apparatus. FIG. 2 is a cross section showing a brief configuration. Basic arrangements are similar to those of the first embodiment, and only portions different from the first embodiment are described.

As shown in FIG. 2, a scanning device 200 is provided on the main body 100. The scanning device 200 has therein an image sensor 201, such as a contact image sensor (CIS) or a charge coupled device (CCD) image sensor. Data of a document read by the image sensor 201 is transmitted to the main body 100 and is processed.

The main body 100 has a configuration similar to that of the above-described embodiment.

Figure 3:
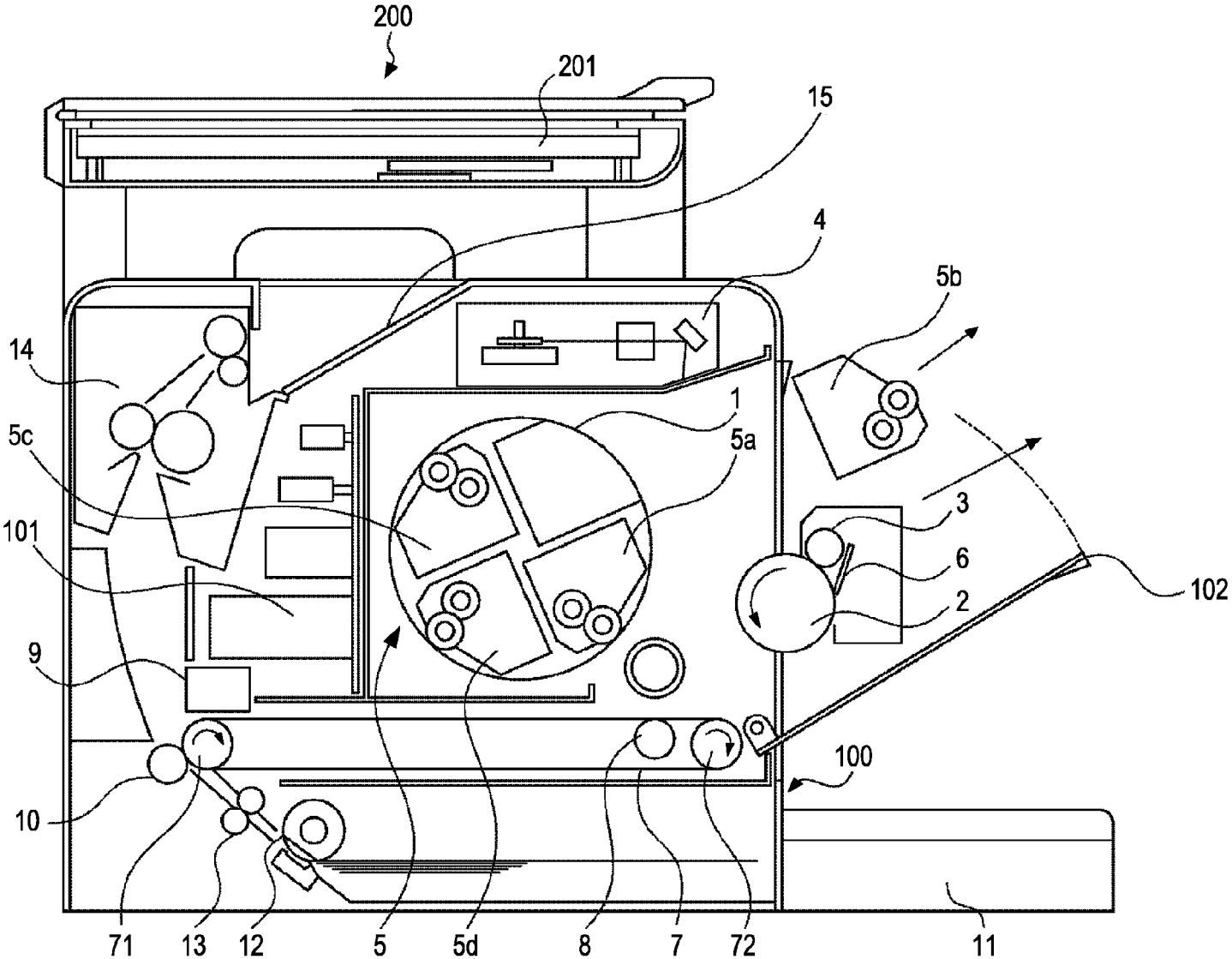
FIG. 3 is an illustration showing the image forming apparatus according to the second embodiment during replacement of a cartridge.
Figure 4:
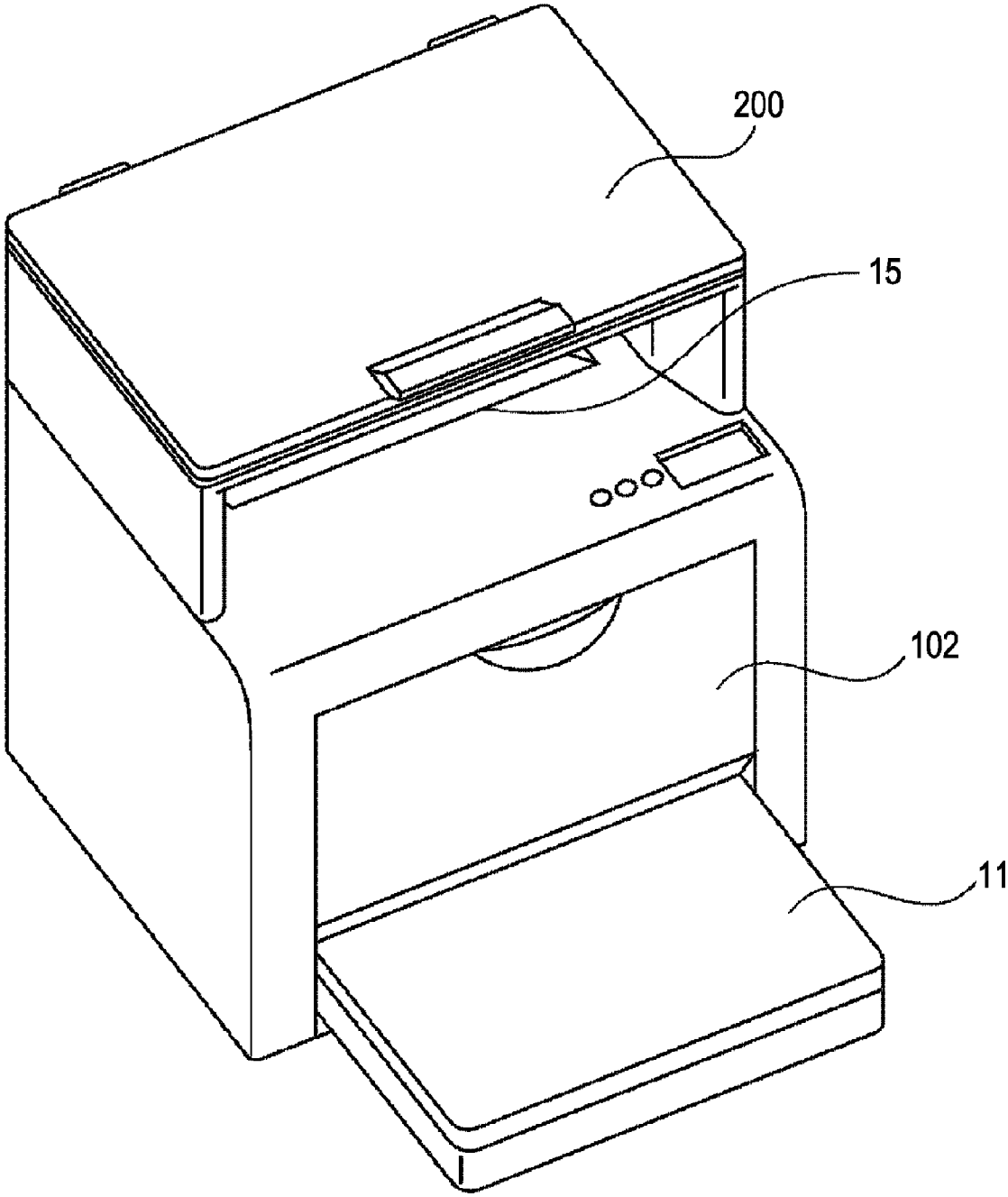
FIG. 4 is a perspective view showing the image forming apparatus according to the second embodiment.
Figure 5:
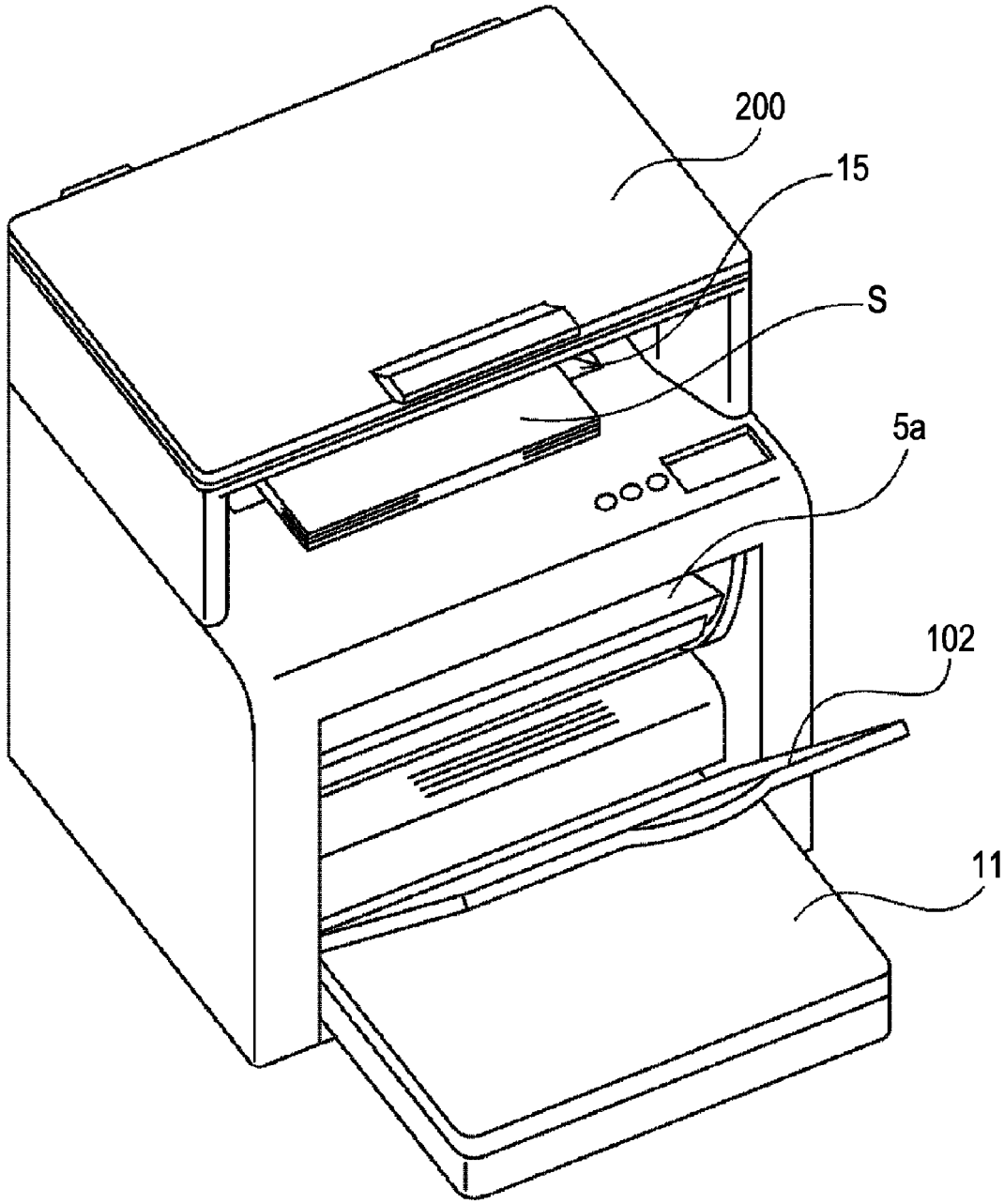
FIG. 5 is an illustration showing the image forming apparatus according to the second embodiment during replacement of a cartridge.

As shown in FIGS. 3 to 5, to replace the used developing devices 5*a* to 5*d*, the used photosensitive drum 2, and the like, a front cover 102 is opened, which is an opening and closing member located at the front side of the main body 100. In particular, when a developing device or a photosensitive drum is removed or installed, the opening and closing member provided on the front side of the main body 100 and being capable of opening and closing the main body 100, is opened.

The rotary member 1 is rotated as required, and a desired developing device to be replaced is stopped at a predetermined position. Then the desired developing device is replaced. In an example shown in FIG. 3, the developing device 5*b* can be drawn from an opening portion. Also, the photosensitive drum 2 can be drawn from the same opening portion. The photosensitive drum 2, the charging roller 3, and the drum cleaning unit 6 are integrated as a process cartridge. The process cartridge is installed to or removed from the main body 100.

In this embodiment, the developing devices 5*a* to 5*d*, the photosensitive drum 2, and the like, can be replaced without the scanning device 200 provided on the main body 100 or the output sheet S being retracted.

In general, to replace a developing device, a scanning device provided on a main body of an apparatus is retracted using a mechanism such as a hinge, to open the upper side of the main body. In contrast, in this embodiment, the scanning device having a certain weight does not have to be opened and closed. In other words, it is not necessary to reinforce the main body to have a certain strength so as to add an opening and closing mechanism such as a hinge and to open and close the mechanism. The scanning device should have a certain degree of accuracy. To obtain the accuracy, and to prevent the breakage, it is desirable that the scanning device is fixed. Also, in view of the breakage prevention, a component such as a dumper to prevent rapid opening and closing of the scanning device does not have to be added. When the scanning device is opened and closed, the center of gravity of the entire apparatus is shifted, which may restrict the center of gravity of the main body, and the decrease in size of the main body. In contrast, this embodiment does not have such a problem.

Therefore, in this embodiment, the image forming apparatus satisfying the basic performance of the main body, and decreasing the size of the main body can be provided.

Other configurations relating to the main body are similar to those in the first embodiment. Therefore, this embodiment may have advantages similar to those in the first embodiment.

In particular, in this embodiment, the photosensitive drum 2 is arranged at the most downstream portion in the conveying direction above the upper surface of the intermediate transfer belt 7. Accordingly, the distance to the secondary-transfer nip portion N2 can be substantially a half of the length of the intermediate transfer belt 7. Thus, the first print time can be decreased.

Also, in this embodiment, with respect to the intermediate transfer belt 7 arranged substantially horizontally, the photosensitive drum 2 is arranged at the most downstream portion in the conveying direction above the upper surface of the intermediate transfer belt 7, the rotary member 1 is arranged upstream of the photosensitive drum 2, the power board 101 is arranged upstream of the rotary member 1, and the exposure device 4 is arranged above the photosensitive drum 2 within the upper projection plane of the intermediate transfer belt 7. Accordingly, the dimension of the main body 100 in the conveying direction of the intermediate transfer belt 7 can be decreased. Further, the exposure device 4 can be arranged above the rotary member 1 and the photosensitive drum 2. Accordingly, the exposure device 4 can be prevented from being degraded as a result of getting dirt by a toner.

The photosensitive drum 2 is arranged at the most downstream portion in the conveying direction above the upper surface of the intermediate transfer belt 7. Accordingly, the rotary member 1 can be arranged directly above the intermediate transfer belt 7. Also, the rotary member 1 is arranged near the intermediate transfer belt 7. Accordingly, the height of the main body 100 can be decreased.

The power board 101, in which the elements generate heat upon power distribution, is arranged upstream of the rotary member 1 within the upper projection plane of the intermediate transfer belt 7. Accordingly, the influence on the intermediate transfer belt 7 and the developing devices 5*a* to 5*d* by the heat generated from the elements can be decreased, and the generated heat can be exhausted to the upper portion of the main body 100. Therefore, the temperature rise in the inside of the apparatus can be prevented. Further, the fixing device 14, which is a heat source, is arranged at the upper portion of the main body 100. Accordingly, the influence of the heat on the intermediate transfer belt 7 and the developing devices 5*a* to 5*d* can be decreased, and the generated heat can be exhausted to the upper portion of the main body 100, in a manner similar to the power board 101.

The rotating direction of the rotary member 1 is determined to be from the lower side to the upper side in an area where the rotary member 1 faces the fixing device 14 and the power board 101, which are heat sources. Accordingly, the rotary member 1 generates the air flow in the same direction as the rotating direction. The heat can be prevented from staying in the apparatus, and the heat can be exhausted to the upper portion of the main body 100.

The photosensitive drum 2 is arranged at the most downstream portion in the conveying direction above the upper surface of the intermediate transfer belt 7. Accordingly, the photosensitive drum 2, the developing devices 5*a* to 5*d*, and the like, can be replaced from a portion of the main body 100, the portion being located above the intermediate transfer belt 7 on the downstream side in the conveying direction. Thus, the developing devices 5*a* to 5*d* can be replaced without the scanning device 200 provided on the upper surface of the main body 100 or the printed sheet S being retracted.

Third Exemplary Embodiment

Next, an embodiment of the invention, capable of increasing the capacity of a toner container, is described below.

Figure 6:
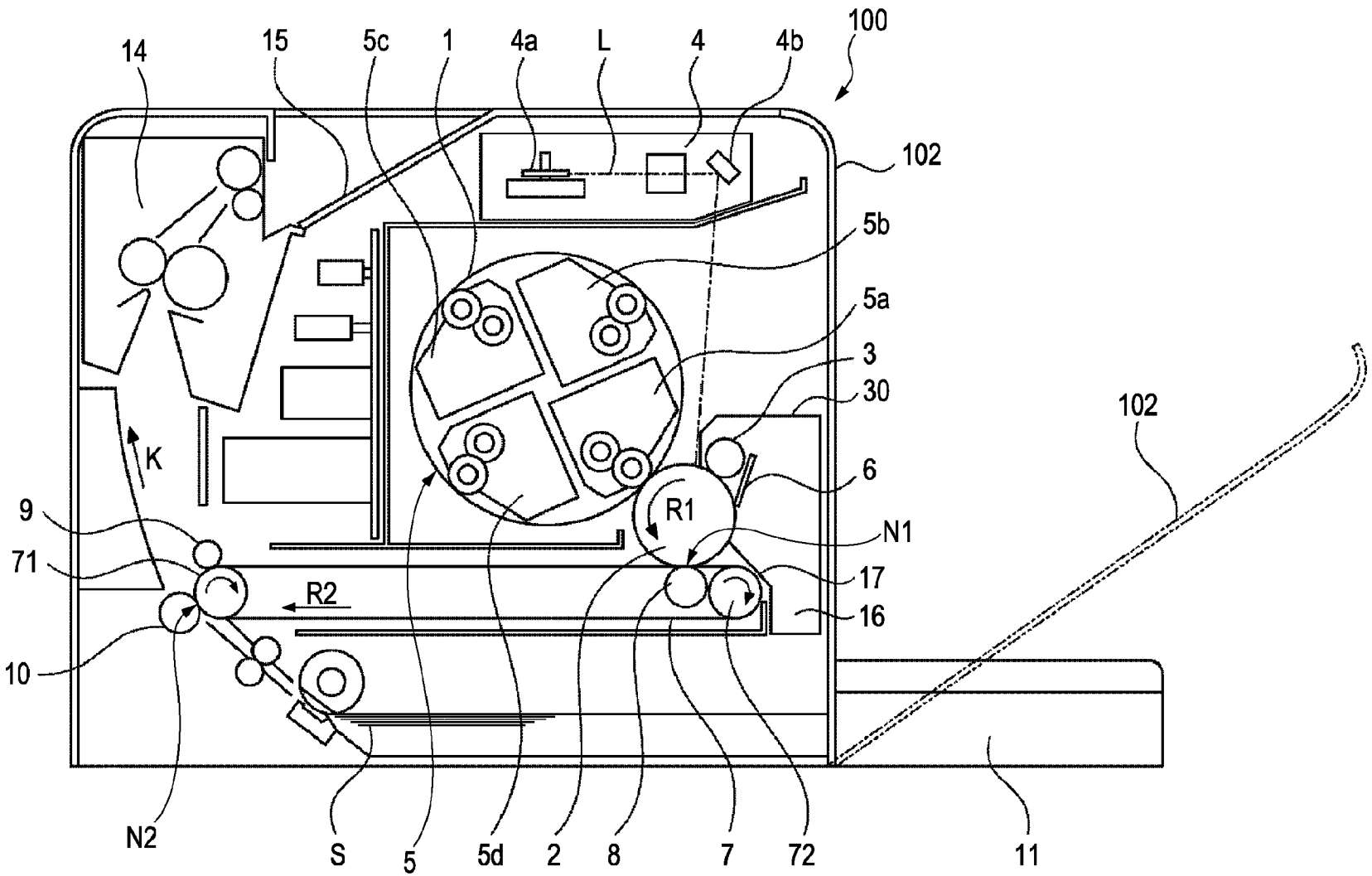
FIG. 6 is an illustration showing an example image forming apparatus according to a third exemplary embodiment of the present invention.

FIG. 6 is a vertical cross section showing an example configuration of an image forming apparatus according to a third embodiment of the invention. The image forming apparatus in the drawing is an electrophotographic type, four-full-color (four-path) laser beam printer using an intermediate transfer belt.

The image forming apparatus shown in FIG. 6 includes an electrophotographic photosensitive member (hereinafter, referred to as photosensitive drum) 2 of drum type serving as an image bearing member to bear a toner image. The photosensitive drum 2 has an aluminum cylinder and a photoconductive layer on the outer periphery of the aluminum cylinder. The photosensitive drum 2 is rotatably supported by a main body 100 of the image forming apparatus (hereinafter, referred to as main body), and is driven to be rotated by a driving unit (not shown) in a direction indicated by arrow R1.

A charging roller 3, an exposure device 4, a developing unit 5, an intermediate transfer belt 7, a drum cleaning unit 6, and the like, are provided in the vicinity of the photosensitive drum 2, substantially in that order in the rotating direction of the photosensitive drum 2. A charging roller (charging unit) 3 is contact type and uniformly charges the surface of the photosensitive drum 2 with electricity. The exposure device (exposure unit) 4 irradiates the surface of the photosensitive drum 2 to a laser beam L to form an electrostatic latent image in accordance with image information. The developing unit 5 includes developing devices 5*a* to 5*d* for colors of yellow, magenta, cyan, and black, which are installed to a rotary member 1 called rotary unit or carousel, and causes a toner to adhere on an electrostatic latent image to develop the electrostatic latent image as a toner image. The intermediate transfer belt 7 comes into contact with the photosensitive drum 2, so that the toner image on the photosensitive drum 2 is transferred (primarily transferred) on the intermediate transfer belt 7.

A cleaning unit includes the drum cleaning unit 6, which is a removing unit to remove a toner (post-transfer remaining toner) remaining on the photosensitive drum 2 after transferring, and a waste-toner container 16, which is a containing unit to contain the toner (waste toner) removed by the drum cleaning unit 6.

The exposure device 4 includes a laser oscillator (not shown) to emit a laser beam L in accordance with image information, a polygonal mirror 4*a* as a device scanning the laser beam L, a mirror 4*b*, and the like. The exposure device 4 exposes the surface of the charged photosensitive drum 2 to the light to form an electrostatic latent image in accordance with the image information.

Herein, the developing devices 5*a* to 5*d* are configured as development cartridges, and hence, a user can replace a cartridge. The photosensitive drum 2, the charging roller 3, the drum cleaning unit 6, the waste-toner container 16, and the like, are integrated as a process cartridge 30. The user can also replace the process cartridge 30.

The user is accessible to the developing devices 5*a* to 5*d* and the process cartridge 30 by opening a front cover 102, which is an opening and closing member provided at the front side of the main body 100 (right side in FIG. 6). The front cover 102 is provided at a position opposite to the photosensitive drum 2 with the waste-toner container 16 being interposed therebetween. The front cover 102 can open and close the main body 100. When the front cover 102 is open, an opening portion is formed at the main body 100. The developing devices 5*a* to 5*d* and the process cartridge 30 can be removed from or installed to the main body 100 through the opening portion. At this time, the rotary developing unit 5 is rotated, so that a desired developing device to be replaced is moved to a replacement position.

The intermediate transfer belt 7 is an endless belt. The intermediate transfer belt 7 is supported by two supporting rollers (first and second rotation members), and is substantially horizontally arranged. One of the two supporting rollers is a driving roller 71, and the other is a support roller (which is a driven roller) 72. The driving roller 71 is rotated by a driving unit (not shown), and accordingly, the intermediate transfer belt 7 is driven (moved) in a direction indicated by arrow R2. A primary transfer roller (primary transfer member) 8 is arranged inside the intermediate transfer belt 7. The primary transfer roller 8 presses the intermediate transfer belt 7 to the photosensitive drum 2 using a pressing unit (not shown). The photosensitive drum 2 and the primary transfer roller 8 are pressed to each other with the intermediate transfer belt 7 being interposed therebetween, to form a primary-transfer nip portion N1. In other words, the intermediate transfer belt 7 comes into contact with the photosensitive drum 2, and a contact portion is formed between the photosensitive drum 2 and the intermediate transfer belt 7. A power source (not shown) applies a primary transfer bias to the primary transfer roller 8.

A secondary transfer roller (secondary transfer member) 10 is arranged outside the intermediate transfer belt 7. The driving roller 71 and the secondary transfer roller 10 are pressed to each other with the intermediate transfer belt 7 being interposed therebetween, to form a secondary-transfer nip portion N2. A power source (not shown) applies a secondary transfer bias to the secondary transfer roller 10.

In addition, a belt cleaning unit (roller charger) 9 of electrostatic type for the intermediate transfer belt 7 is arranged downstream of the secondary-transfer nip portion N2 and upstream of the primary-transfer nip portion N1, so as to face the intermediate transfer belt 7. The belt cleaning unit 9 can come into contact with or away from the surface of the intermediate transfer belt 7. The belt cleaning unit 9 has a power source (not shown).

A fixing device (fixing unit) 14 is arranged downstream of the secondary-transfer nip portion N2 in the conveying direction (direction indicated by arrow K) of a sheet (transferring material) S which is fed and conveyed from the sheet feeding cassette 11. The fixing device 14 fixes an unfixed toner image transferred on the sheet S by heating and pressing.

Next, an operation of the image forming apparatus having the above-described configuration is described.

A charging bias, in which a direct voltage and an alternating voltage are superposed, is applied to the charging roller 3, and hence, the surface of the photosensitive drum 2 driven to be rotated in a direction indicated by arrow R1 is uniformly charged. When a yellow image signal is input to the laser oscillator (not shown), a laser beam L is emitted on the surface of the charged photosensitive drum 2, and an electrostatic latent image is formed. When the photosensitive drum 2 is further rotated in the direction indicated by arrow R1, the yellow developing device 5*a* causes a yellow toner to adhere on the electrostatic latent image on the photosensitive drum 2, to develop the electrostatic latent image as a toner image. The toner image on the photosensitive drum 2 for yellow is primarily transferred on the intermediate transfer belt 7 at the primary-transfer nip portion N1 because of the primary transfer bias applied to the primary transfer roller 8. After the toner image is transferred, the drum cleaning unit 6 removes a primary-transfer remaining toner on the surface of the photosensitive drum 2, the toner which has not been transferred on the intermediate transfer belt 7 and remained on the photosensitive drum 2. The photosensitive drum 2 thus prepares for the next image formation. The waste-toner container 16 collects the toner remaining after the transfer.

The above-described image formation process including charging, exposing, developing, primarily transferring, and cleaning, is repeated for other three colors of magenta, cyan, and black. Accordingly, a four-color toner images are formed on the intermediate transfer belt 7. The rotary developing unit 5 has four-color developing devices installed therein, that is, the developing device 5*a* for yellow, the developing device 5*b* for magenta, the developing device 5*c* for cyan, and the developing device 5*d* for black. By rotation of the developing unit 5, a developing device subjected to the development of the electrostatic latent image on the photosensitive drum 2 is positioned at the developing position facing the surface of the photosensitive drum 2.

For image formation with four full colors, the developing unit 5 is rotated by 90 degrees each. Therefore, the developing devices 5*a* to 5*d* are sequentially arranged at the developing position. The developing position of the developing device 5*a* to 5*d* at the development is above the primary-transfer nip portion N1, and hence, a complicated structure utilizing developing with pumping or the like to convey the toner from the lower side to the upper side in a developing device is not necessary.

The four-color toner images superposed on the intermediate transfer belt 7 as described above are secondarily transferred on a sheet S which is conveyed in the direction indicated by arrow K at the secondary-transfer nip portion N2 because of a secondary transfer bias applied by a power source (not shown) to the secondary transfer roller 10, and then, the sheet S is output to a sheet output portion defined at an upper cover 15. Accordingly, a four-full-color image can be provided on the sheet S.

After the toner images are transferred, the belt cleaning unit 9 applies a charge having the reversed polarity, that is, a plus charge, to a secondary-transfer remaining toner which has not been transferred on the sheet S and remained on the intermediate transfer belt 7. Accordingly, the secondary-transfer remaining toner is reversely transferred on the photosensitive drum 2 at the primary-transfer nip portion N1, and the drum cleaning unit 6 cleans up the photosensitive drum 2. The reversely transferred secondary-transfer remaining toner together with the primary-transfer remaining toner on the photosensitive drum 2 are removed by the drum cleaning unit 6 and collected in the waste-toner container 16.

Herein, the features of the embodiment are described. The waste-toner container 16 of the process cartridge 30 is installed at the position opposite to the developing device performing the development, with the primary-transfer nip portion N1 being interposed therebetween. The installation condition may be that these components are arranged at the upper and lower positions with the primary-transfer nip portion N1 being interposed therebetween.

In particular, the waste-toner container 16 is provided at an end portion of the intermediate transfer belt 7 in the moving direction of the intermediate transfer belt 7. The waste-toner container 16 is provided over a position corresponding to the primary-transfer nip portion N1 between the photosensitive drum 2 and the intermediate transfer belt 7 in the arrangement direction of the photosensitive drum 2 and the intermediate transfer belt 7. To be more specific, the waste-toner container 16 extends from a position near the image bearing member (photosensitive drum 2) to a position near the first rotation member (support roller 72) by which the intermediate transfer belt 7 is supported. The arrangement direction of the photosensitive drum 2 and the intermediate transfer belt 7 in this embodiment is a vertical direction.

Figure 7:
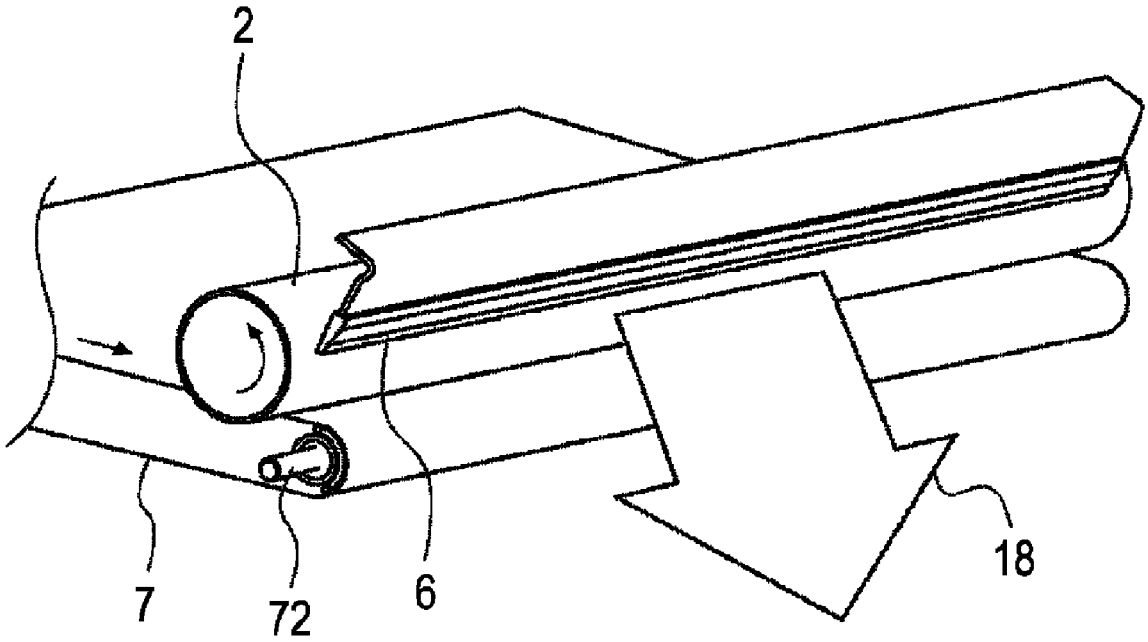
FIG. 7 is an illustration showing a cleaning unit according to the third embodiment.

The waste-toner container 16 does not have a toner conveying unit. Accordingly, the transfer remaining toner removed by the drum cleaning unit 6 falls in the waste-toner container 16 merely by the gravity. The toner falling direction is the belt conveying direction, that is, a direction indicated by arrow 18 in FIG. 7. In this embodiment, the angle of a surface 17 (FIG. 6) where the toner falls is about 50 degrees with respect to a horizontal level. The angle may be 45 degrees or more, empirically.

If a configuration is employed in which the developing position of the developing device during development is below the primary-transfer nip portion N1, the waste toner can fall easily and can be collected easily, however, a complicated structure or the like utilizing developing with pumping to convey the toner from the lower side to the upper side in a developing unit is necessary. In this embodiment, such a complicated developing device configuration is not necessary, a toner conveying mechanism at the waste-toner container 16 may be omitted, and the capacity of the waste-toner container 16 can be increased.

In this embodiment, as shown in FIG. 6, the intermediate transfer belt 7 is supported by the two shafts, and the installation angle corresponds to a substantially horizontal level. Advantages of this configuration are decreasing a wasted space inside the belt in comparison with the three-shaft support, and decreasing the height of the main body 100 in comparison with a case where the angle of an intermediate transfer belt is oblique or perpendicular to the horizontal level, thereby decreasing the size of the apparatus.

As shown in FIG. 6, while the intermediate transfer belt 7 is arranged substantially horizontally, the primary-transfer nip portion N1 is arranged at the end portion of the intermediate transfer belt 7 in the conveying direction, so that a toner falls from a portion near the conveying surface of the intermediate transfer belt 7 by the gravity. Accordingly, the waste-toner container 16 having a large capacity can easily collect the waste toner, without using a toner conveying mechanism.

With the above configuration, the simple configuration without the toner conveying mechanism can be provided, and the capacity of the waste-toner container 16 can be increased. Thus, the process cartridge 30 does not have to be replaced for a long period.

Figure 8:
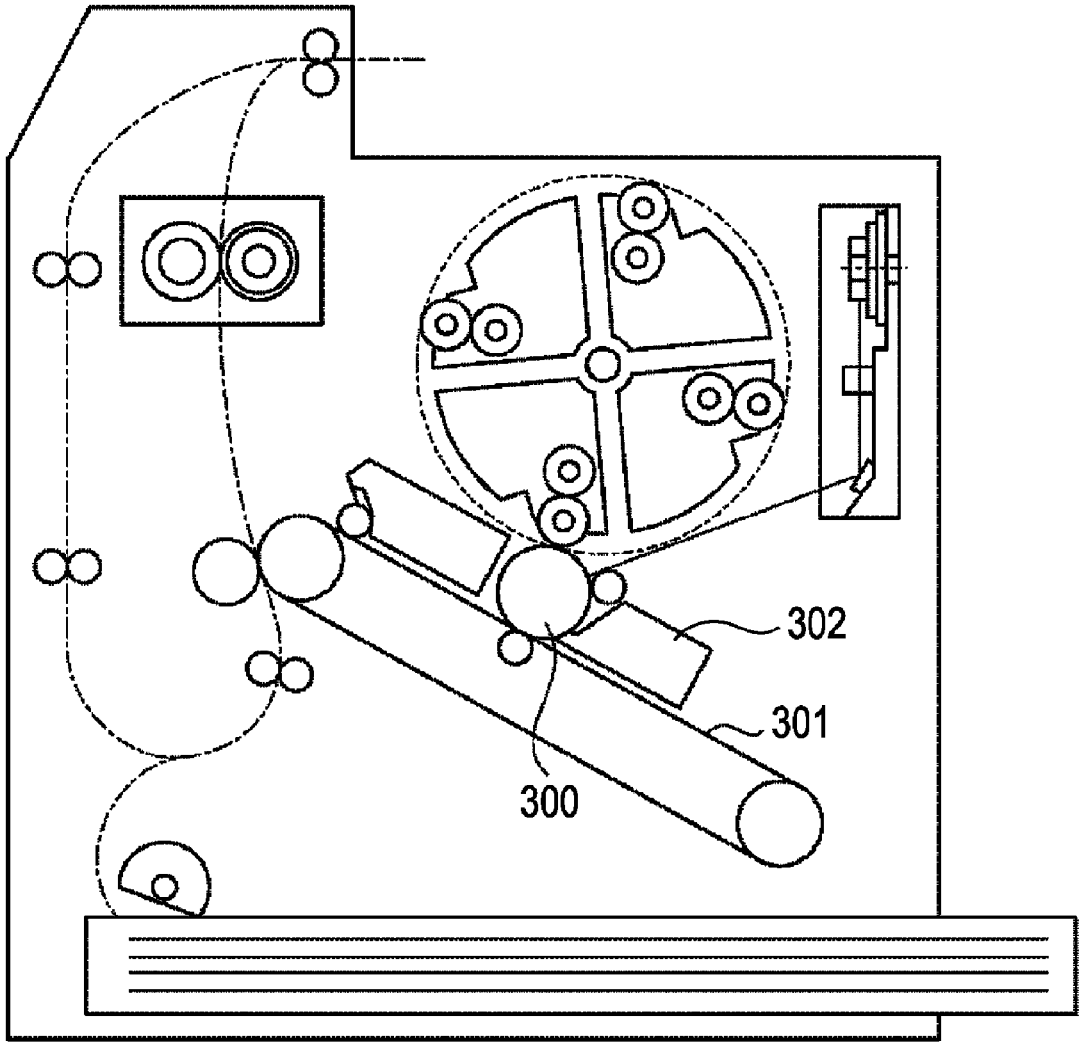
FIG. 8 PRIOR ART
FIG. 8 is an illustration showing an image forming apparatus of a related art.

When the front cover 102 is open, the waste-toner container 16 extends over the photosensitive drum 2 and the intermediate transfer belt 7 when viewed from the opening portion formed at the main body 100. That is, the waste-toner container 16 occupies an area extending from the upper side to the lower side of the primary-transfer nip portion N1. Accordingly, the photosensitive drum 2 can be prevented from being exposed to light. As shown in FIG. 8, if a waste-toner container 302 is provided only at an upper portion of a primary-transfer nip portion, for example, when a user opens a front cover to replace a developing device, light may enter, and a photosensitive drum may be exposed to the light, thereby generating a defective image. In this embodiment, as shown in FIG. 6, a portion of the photosensitive drum 2 extending from the upper side to the lower side of the primary-transfer nip portion N1 near the front side of the main body 100 is covered. The photosensitive drum 2 can be prevented from being exposed to the light. Herein, a proper portion of the waste-toner container 16 may be molded using a colored member having a light-shielding color of, for example, black, so as to provide a light-shielding property.

Since the waste-toner container 16 extends over the area from the upper side to the lower side of the primary-transfer nip portion N1, the waste-toner container 16 can protect the intermediate transfer belt 7. As shown in FIG. 8, if the waste-toner container 302 is provided only at the upper portion of the primary-transfer nip portion, for example, when a user opens a front cover to replace a developing device, a portion of the intermediate transfer belt 301 near the front side of the main body may be exposed. Due to this, the user may unintentionally touch the portion, or may hurt the portion.

In this embodiment, as shown in FIG. 6, a portion of the intermediate transfer belt 7 extending from the upper side to the lower side of the primary-transfer nip portion N1 near the front side of the main body 100 is covered with the waste-toner container 16. Accordingly, the intermediate transfer belt 7 can be protected.

Also, in this configuration, since the waste-toner container 16 collects both primary-transfer remaining toner and secondary-transfer remaining toner, a collecting unit for cleaning the belt is not necessary. In this configuration, the capacity of the waste-toner container 16 is large, which is sufficient for collecting both primary-transfer remaining toner and secondary-transfer remaining toner.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-124691 filed May 9, 2007 and No. 2007-124692 filed May 9, 2007, which are hereby incorporated by reference herein in their entirety.

What is claimed is:

1. An image forming apparatus comprising:

an image bearing member;

an exposure unit configured to expose the image bearing member to light;

a developing unit including a plurality of developing devices, and being configured to support the developing devices rotatably relative to the image bearing member;

a movable intermediate transfer belt supported by first and second rotation members;

a primary transfer member, the primary transfer member and the image bearing member being configured to form a primary transfer portion with the intermediate transfer belt being interposed therebetween; and a secondary transfer member, the secondary transfer member and the second rotation member being configured to form a secondary transfer portion with the intermediate transfer belt being interposed therebetween, wherein a toner image which is formed on the image bearing member by the developing unit is transferred on the intermediate transfer belt at the primary transfer portion, the toner image on the intermediate transfer belt is conveyed to the first rotation member and then to the secondary transfer portion, and the toner image is transferred on a recording material, and wherein the intermediate transfer belt is arranged substantially horizontally, the primary transfer portion being located on a side of the first rotation member with respect to a center portion between the first rotation member and the second rotation member in a moving direction of the intermediate transfer belt, and the developing unit faces the intermediate transfer belt, and wherein the exposure unit, the developing unit, and the image bearing member are arranged above the intermediate transfer belt and within a width of the intermediate transfer belt in a moving direction of the intermediate transfer belt in relation to a horizontal direction.

2. The image forming apparatus according to claim 1, wherein the primary transfer portion is located near the first rotation member.

3. The image forming apparatus according to claim 1, wherein a lowermost portion of the developing unit is located below the center of the image bearing member.

4. The image forming apparatus according to claim 1, further comprising a power unit configured to supply power to components in a main body of the apparatus, the power unit being arranged above the intermediate transfer belt and within the width of the intermediate transfer belt in the moving direction of the intermediate transfer belt in relation to the horizontal direction.

5. The image forming apparatus according to claim 1, further comprising:

a feeding unit configured to supply the recording material to the secondary transfer portion; and a fixing unit configured to fix the toner image transferred at the secondary transfer portion on the recording material, wherein the recording material is conveyed from the feeding unit to the fixing unit through a recording material conveying path from a lower side to an upper side, whereas the developing unit is rotated from the lower side to the upper side, in a side of the recording material conveying path.

6. The image forming apparatus according to claim 1, further comprising:

a scanning device provided at an upper portion of a main body of the apparatus; and an opening and closing member provided at a side surface of the main body and capable of opening and closing the main body to remove or install the developing device.

7. The image forming apparatus according to claim 1, further comprising:

a removing unit configured to remove a toner remaining on the image bearing member after transferring; and a containing unit configured to contain the toner removed by the removing unit, the containing unit being provided at an end portion of the intermediate transfer belt in the moving direction of the intermediate transfer belt, the containing unit extending over a position corresponding to the primary transfer portion in an arrangement direction of the image bearing member and the intermediate transfer belt.

8. The image forming apparatus according to claim 7, wherein the containing unit extends from a side of the image bearing member to a side of the first rotation member.

9. The image forming apparatus according to claim 7, wherein the arrangement direction of the image bearing member and the intermediate transfer belt is a vertical direction.

10. The image forming apparatus according to claim 7, further comprising an opening and closing member provided at a position opposite to the image bearing member with the containing unit being interposed therebetween, the opening and closing member being capable of opening and closing with respect to a main body of the apparatus.

11. The image forming apparatus according to claim 10, wherein the containing unit extends over the image bearing member and the intermediate transfer belt as viewed from an opening portion which is formed at a main body of the apparatus when the opening and closing member is open.

12. The image forming apparatus according to claim 11, wherein the developing device is capable of being removed or installed through the opening portion.

13. The image forming apparatus according to claim 10, wherein the containing unit has a light-shielding property.

14. The image forming apparatus according to claim 7, wherein the containing unit contains a toner remaining on the intermediate transfer belt by utilizing the image bearing member.

* * * * *